United States Patent [19]

Saunders

[11] 3,989,166

[45] Nov. 2, 1976

[54] APPARATUS FOR METERING AND DISPENSING

[75] Inventor: George Saunders, Chicago, Ill.

[73] Assignee: Lawrence Peska Associates, Inc., New York, N.Y. ; a part interest

[22] Filed: Aug. 4, 1975

[21] Appl. No.: 601,806

[52] U.S. Cl. ..... 222/48; 222/196.1; 222/370

[51] Int. Cl.[2] ..... B67D 5/22

[58] Field of Search ..... 222/345, 348, 354, 367, 222/370, 454, 452, 480, 196.1, 41, 42, 47, 48, 427, 430; 221/265

[56] References Cited

UNITED STATES PATENTS

| | | | |
|---|---|---|---|
| 2,837,256 | 6/1958 | Danet | 222/568 |
| 2,901,150 | 8/1959 | Matter | 222/370 |
| 2,944,707 | 7/1960 | Steinmetz | 222/370 |
| 3,122,275 | 2/1964 | Maxim | 222/196.1 |

FOREIGN PATENTS OR APPLICATIONS

| | | | |
|---|---|---|---|
| 595,071 | 2/1958 | Canada | 222/370 |

*Primary Examiner*—Robert B. Reeves
*Assistant Examiner*—H. Grant Skaggs

[57] ABSTRACT

The present invention relates to apparatus for metering and dispensing seasonings such as salt, pepper, sugar and the like. In one embodiment a salt shaker is provided with a calibrated top so as to dispense a desired amount of salt as needed.

3 Claims, 5 Drawing Figures

APPARATUS FOR METERING AND DISPENSING

SUMMARY OF THE INVENTION

The present invention relates to apparatus for metering and dispensing granular materials, e.g., seasonings such as salt, pepper, sugar and the like. In one embodiment a salt shaker is provided with a calibrated top so as to dispense a desired amount of salt as needed. The embodiment comprising the salt shaker is especially useful for persons on a salt controlled diet or for generally controlling the daily amount of salt intake. The apparatus for metering and dispensing granular materials such as seasonings comprises a head for storing and dispensing a measured quantity of granular material, an influent port for introducing granular material into the head and a metering device mounted on the head for metering a measured quantity of granular material into the head.

DETAILED DESCRIPTION

Figure 1:
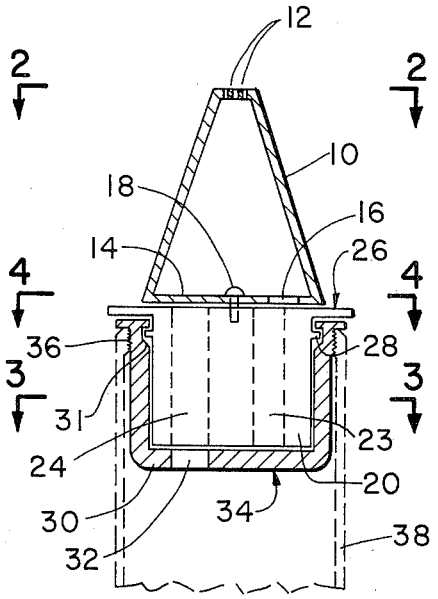
FIG. 1 is a side elevation in section showing the metering and dispensing apparatus of the present invention.
Figure 2:
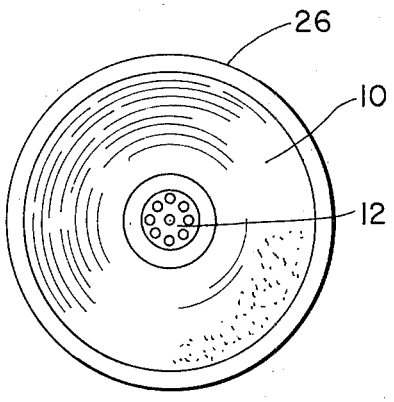
FIG. 2 is a plan view of the metering and dispensing apparatus of the present invention taken along the line 2—2 from FIG. 1.
Figure 3:
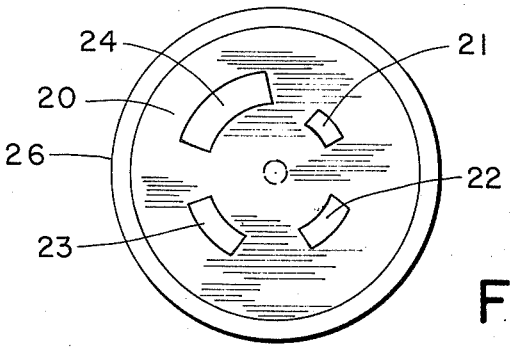
FIG. 3 is a plan view in section of the metering and dispensing apparatus of the present invention taken along the line 3—3 from FIG. 1 and illustrates the effluent ends of the various chambers employed for metering a specified amount of granular solid material into the dispensing portion of the apparatus.

Many people who are on restrictive diets or who are voluntarily limiting the daily intake of certain seasonings such as salt, pepper, sugar or other condiments and the like are unable to determine on a daily basis the amount of such restricted items ingested. This is especially the case where low salt diets are prescribed since ordinary salt shakers contain far in excess of the maximum daily amount permitted in such diets and it is difficult for the person to determine by an examination of the salt shaker, precisely how much salt has been consumed by him on any one day.

It is therefore an object of the present invention to overcome these and other difficulties encountered in the prior art.

It is a further object of the present invention to provide apparatus for metering and dispensing a measured quantity of a granular material, especially a food seasoning.

These and other objects have been achieved by the present invention which will become apparent from the specification and claims that follow taken together with the appended drawing.

FIGS. 1–5 of the appended drawing illustrate the apparatus for metering and dispensing according to the present invention wherein dispensing head 10 is shown which may be constructed of any metal or plastic material as is the case with the other members of the apparatus of the present invention, a clear plastic material being especially useful to aide in determining the amount of solid granular material that has been dispensed from the head 10. Examples of such clear plastic materials that may be used in this regard include inter alia polymers of styrene, acrylic acid, methacrylic acid, the lower alkyl esters of such acids, acrylonitrile, and the various copolymers thereof which are well known in the art such as styrene-acrylonitrile copolymers and the like. Head 10 is frustoconical in shape and has dispensing holes 12 at the top thereof which are slightly larger in diameter than the granules of the granular material to be dispensed. Head 10 terminates in a base 14 which has an influent port 16 located therein for passing metered quantities of granular material into the interior portion of head 10. A flared-head pin 18 rotatably secures head 10 to metering cylinder 20 the latter having metering chambers 21, 22, 23 and 24 therein which are rotatable, said metering chambers being of different volumetric capacities and being calibrated to receive a specific amount of granular material that is to be dispensed. The metering chambers all have influent ports at the bottom and effluent ports at the top for receiving granular material and discharging it in metered amounts into head 10. Cylinder 20 has collar 26 integral therewith which can be grasped with the fingers and rotated to change the position of the influent and effluent ports of the chambers 21, 22, 23 and 24 with respect to either influent port 16 in head 10 or influent portion 32 in the base 34 of closure 30, closure 30 rotatably receiving and enclosing the walls and the base of cylinder 20. Closure 30 has rim receiving groove 31 for receiving rim 28 which is integral with cylinder 20 and allows cylinder 20 to rotate freely in closure 30 and further provides a seal so that granular material cannot readily flow over rim 28. Screw threads 36 located on the upper periphery of closure 30 allow the closure to be screwingly attached to a container for storing granular materials such as container 38 partially shown in phantom configuration.

Figure 5:
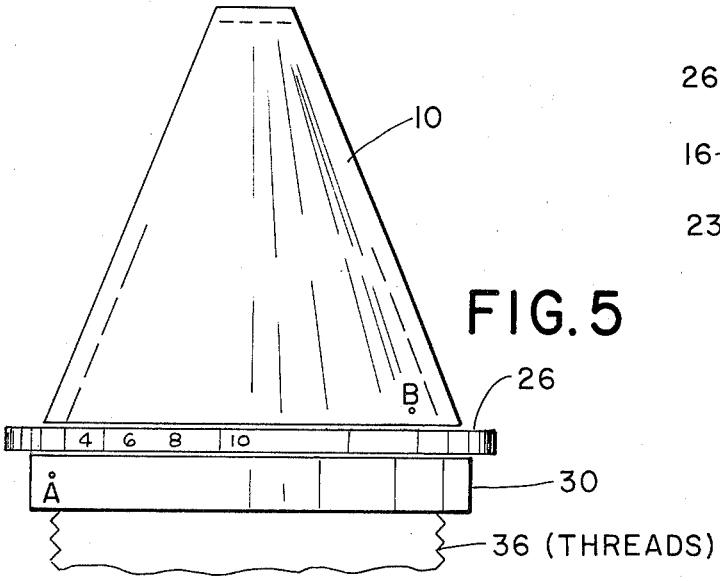
FIG. 5 is a partial side elevation of the metering and dispensing apparatus of the present invention, calibration symbols and reference points being inscribed thereon to indicate the amount of granular material to be delivered to the dispensing head.
Figure 4:
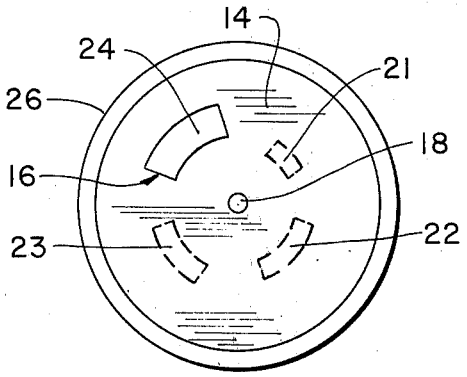
FIG. 4 is a plan view in section of the metering and dispensing apparatus of the present invention taken along the line 4—4 from FIG. 1 and illustrates the influent port in the base of the dispensing head of the apparatus through which metered quantities of granular solid material is delivered to the dispensing head.

In operation, the apparatus of the present invention is used to meter and dispense granular materials which can be readily appreciated by referring to the drawing and especially to FIGS. 1 and 5 wherein chamber 24 is in a position such that the influent end thereof is in register with the influent port 32 in base 30. When the dispensing apparatus of the present invention is inverted from the position shown in the drawing, granular material will flow into chamber 24 until the chamber is filled, the effluent end of chamber 24 being sealed by base 14 of head 10. Influent port 32 is in register with the influent port of chamber 24 when the numeral "10" on collar 26 as shown in FIG. 5 is brought into alignment with the letter "A" on the rim of closure 30. While the dispensing device is still inverted, collar 26 is rotated until the numeral 10 is aligned with the letter "B" on the base of head 10. By thus rotating collar 26, the effluent end of chamber 24 is brought into register with influent port 16 in base 14 of head 10. Granular material in chamber 24 then flows into head 10 and the dispenser is righted. Any granular material that may fall back into chamber 24 is prevented from re-entering container 38 by virtue of the base 34 of closure 30 which acts to seal the influent end of chamber 24 when the chamber is arranged to discharge its contents into the head 10. The granular material may now be dispensed from head 10 by inverting the apparatus of the present invention and shaking it in an up and down direction. The other chambers may be similarly filled and discharged into head 10 however employing the other numbers 4, 6 or 8 on the calibrated edge of rim 26 as shown in FIG. 5, so that the chamber corresponding to number 4 will be filled when the apparatus of the present invention is inverted and that number is brought into register with the letter A on the rim of closure 30 and then into register with the letter B at the base of head 10 and so forth for the other chambers and the numbers that correspond thereto on the edge of rim 26.

Although the invention has been described by reference to some embodiments it is not intended that it is to be limited thereby, but that certain modifications are intended to be included as falling within the broad scope and spirit of the foregoing disclosure, the following claims and the appended drawing.

What is claimed is:

1. Apparatus for metering and dispensing which comprises head means for storing and dispensing a measured quantity of a granular food seasoning material, perforate openings in the top of said head of a diameter slightly larger than the diameter of the grains of the granular material to be dispensed, base means in said head, cylinder means rotatably mounted on said base of said head and having a plurality of chamber means each of a different volume with influent means and effluent means therein for receiving and discharging therefrom a measured quantity of granular food seasoning material, said effluent means of said chamber means rotatably registerable with influent means in said head, closure means for rotatably receiving said cylinder and for enclosing the walls and base of said cylinder, influent means in the base of said closure rotatably registerable with said influent of said chamber means, said base of said head being positionable to close the effluent of one of said chamber means when the influent of said one chamber means so closed is registered with the influent of said closure, the base of said cylinder being positionable with respect to said closure means to close the influent means of one of said chamber means when the effluent means of said chamber is registered with the influent of said head, first indicia means on said head, second indicia means on said cylinder for each of said chamber means and third indicia means on said closure, said first, second and third indicia means being alignable with one another for selecting and charging one of said chamber means and discharging said chamber means into said head.

2. The apparatus of claim 1 where said closure has screw thread means on the exterior wall thereof for screwingly receiving a container for granular material.

3. The apparatus of claim 2 in combination with a container for granular food seasoning material.

* * * * *